US008215252B1

(12) United States Patent
Chun

(10) Patent No.: US 8,215,252 B1
(45) Date of Patent: Jul. 10, 2012

(54) SYSTEM AND METHOD FOR DYNAMIC STABILIZATION AND NAVIGATION IN HIGH SEA STATES

(75) Inventor: Wendell H. Chun, Littleton, CO (US)

(73) Assignee: Lockheed Martin Corporation, Bethesda, MD (US)

( * ) Notice: Subject to any disclaimer, the term of this patent is extended or adjusted under 35 U.S.C. 154(b) by 337 days.

(21) Appl. No.: 12/502,660

(22) Filed: Jul. 14, 2009

(51) Int. Cl.
*B63B 9/08* (2006.01)
*B63H 25/42* (2006.01)

(52) U.S. Cl. ..... 114/121; 440/51; 114/144 B

(58) Field of Classification Search ..... 114/121, 114/144 R, 155, 144 RE, 144 B, 151; 440/51
See application file for complete search history.

(56) References Cited

U.S. PATENT DOCUMENTS

| | | | | |
|---|---|---|---|---|
| 2,979,010 | A | 4/1961 | Braddon et al. | |
| 3,446,173 | A * | 5/1969 | Ohcho et al. | 114/248 |
| 3,757,723 | A | 9/1973 | Pangalila | |
| 3,818,959 | A | 6/1974 | Larsh | |
| 4,645,463 | A * | 2/1987 | Arneson | 440/57 |
| 4,777,899 | A | 10/1988 | Bettcher, Jr. | |
| 5,276,390 | A | 1/1994 | Fisher et al. | |
| 5,414,799 | A | 5/1995 | Seraji | |
| 6,064,924 | A | 5/2000 | Fleischmann | |
| 6,145,378 | A * | 11/2000 | McRobbie et al. | 73/490 |
| 6,978,728 | B2 | 12/2005 | Koop et al. | |
| 7,036,445 | B2 * | 5/2006 | Kaufmann et al. | 114/144 RE |
| 7,335,074 | B2 * | 2/2008 | Arneson | 440/66 |
| 7,339,339 | B2 * | 3/2008 | Kanaoka | 318/568.12 |
| 7,511,736 | B2 * | 3/2009 | Benton | 348/208.14 |
| 7,565,876 | B2 * | 7/2009 | Wilson et al. | 114/122 |
| 2007/0272143 | A1 | 11/2007 | Koop et al. | |

FOREIGN PATENT DOCUMENTS

| | | |
|---|---|---|
| EP | 0754618 A1 | 1/1997 |
| GB | 922977 | 4/1963 |

OTHER PUBLICATIONS

Murphy, Robin R., "Introduction to AI Robotics", The MIT Press, 2000 Massachusetts Institute of Technology, pp. 8-9; 73-74; 257-292.

Arkin, Ronald C., "Behavior-Based Robotics", The MIT Press, 1998 Massachusetts Institute of Technology, pp. 24-27; 66-67; 206-207.

Braitenberg, Valentino, "Vehicles—Experiments in Synthetic Psychology", The MIT Press, 1984 Massachusetts Institute of Technology, Fifth printing 1996, 33-49; 55-61.

(Continued)

*Primary Examiner* — Lars A Olson
*Assistant Examiner* — Andrew Polay
(74) *Attorney, Agent, or Firm* — Howard IP Law Group, P.C.

(57) ABSTRACT

A system is disclosed for dynamically stabilizing a ship in high sea states. A six degree-of-freedom robotic arm is attached to the ship, and a thruster is located at the distal end of the manipulator. The manipulator is be used to orient the thruster to counteract wave forces that act against the ship's hull in real time. This active balancing technique can be used to keep the ship substantially erect in rough seas by making continual corrections to the ship's body attitude. The center of gravity and the center of buoyancy of the ship are utilized, along with a precisely oriented and controlled thrust at the end of the manipulator, to optimally control the ship's state against impending waves.

28 Claims, 8 Drawing Sheets

OTHER PUBLICATIONS

Desai, Rajiv S. et al, "A Simple Reactive Architecture for Robust Robots", Jet Propulsion Laboratory/ California Institute of Technology, Pasadena, CA, Nov. 8, 1998, pp. 1-5.

Brooks, Rodney A. "A Robust Layered Control System for a Mobile Robot", IEEE Journal of Robotics and Automation, vol. RA-2, No. 1, Mar. 1986, pp. 14-23.

Brooks, Rodney A. "A Robust Layered Control System for a Mobile Robot", Massachusetts Institute of Technology Artificial Intelligence Laboratory, A.I. Memo 864, Sep. 1985, pp. 1-25.

Brooks, Rodney A. "Intelligence Without Reason", MIT Artificial Intelligence Lab, Cambridge, MA, pp. 569-595.

"The Specialist Committee on Safety of High Speed Marine Vehicles", Final Report and Recommendations to the 22nd ITTC, 1999.

Pettersen, K. Y., et al, "Underactuated Ship Stabilization Using Integral Control: Experimental Results with Cybership I", Department of Engineering Cybernectics, Norwegian University of Science and Technology, 7034 Trondheim, Norway.

2005 Northrop Grumman Brochure for Gyrofin Stabilisers, Sperry Marine.

* cited by examiner

SYSTEM AND METHOD FOR DYNAMIC STABILIZATION AND NAVIGATION IN HIGH SEA STATES

FIELD OF THE INVENTION

The invention generally relates to shipboard stabilization systems, and more particularly to an active stabilization system for seagoing vessels to enhance vessel performance in extreme sea states.

BACKGROUND

In high sea states (greater than 4 on the Beaufort scale), boats and ships must negotiate a variety of extreme conditions. Excessive rolls, yaws, and pitches, coupled with taking on water make working and living on a ship hazardous. Seakeeping (defined as the ability of a vessel to navigate safely at sea for prolonged periods during stormy weather) limits advanced, high speed, vessels from providing an overall effective platform for many open-water applications—including ferrying, search and rescue operations, and military missions. In high seas, most ships must sacrifice either speed or seakeeping ability, and neither can be achieved without size. To survive in high sea states and maintain speed, conventional displacement ships must be large. The relationship between a ship's maximum speed and its hull length is called "hull speed." Consequently, small, conventional displacement ships are unable to perform high-speed missions in rough seas.

Existing ships often incorporate passive stability systems such as bilge keels, outriggers, anti-roll tanks, and paravanes to reduce the tipping of ships. Active stability systems include the use of stabilizer fins attached to the side of the vessel to counteract unwanted motion of the vessel. Active fin stabilizers are often used to reduce the roll a vessel experiences. There is currently no way to stabilize a ship, and the present solutions are limited to use in countering the small motions of waves.

Thus, there is a need for a dynamic stability system that can assess and counteract a variety of factors that adversely affect ship stability, to provide ships with enhanced ability to perform at extreme sea states.

SUMMARY OF THE INVENTION

The disclosed dynamic stability is a novel approach based on using fast computers, active sensing of sea conditions, and optimal control. The advantage in implementing the disclosed system is that it will provide smaller ships with increased seakeeping capability, especially in open and rough seas where currently there is no practical stability solution.

The disclosed system can be used to dynamically stabilize a ship in high sea states to enhance seakeeping, to enable a smaller ship size to move more rapidly at high sea states, and to maintain speed in rough waters. In one embodiment, a six (6) degree-of-freedom (DOF) manipulator (i.e., robotic arm) may be attached to the ship, with a thruster located at the distal end of the manipulator. The manipulator may be used to orient the thruster to counteract wave forces that act against the ship's hull in real time. This active balancing technique can be used to keep the ship substantially erect in rough seas by making continual corrections to the ship's body attitude. The center of gravity and the center of buoyancy of the ship are utilized, along with a precisely oriented and controlled thrust at the end of the manipulator, to optimally control the ship's state against impending waves.

A system is disclosed for stabilizing a floating body. The system may comprise a manipulator connected to the floating body, the manipulator being selectively adjustable with respect to the floating body. The system may also comprise a thruster positioned on the manipulator arm, a first plurality of sensors for measuring a first characteristic of the floating body, a second plurality of sensors for measuring a fluid force adjacent to the floating body; and a controller configured to adjust a position of the manipulator arm and the thruster based on information received from the first and second plurality of sensors. A thrust generated by the thruster may counteract at least a portion of the measured fluid force.

A system is disclosed for stabilizing a floating body. The system may comprise a manipulator arm connected to the floating body, the manipulator arm having six degrees of freedom with respect to the floating body. The system may further comprise a thruster positioned on the manipulator arm, a first plurality of sensors for measuring a first characteristic of the floating body, a second plurality of sensors for measuring a fluid force adjacent to the floating body; and a controller configured to adjust a position of the manipulator arm and the thruster based on information received from the first and second plurality of sensors. A thrust generated by the thruster counteracts at least a portion of the measured fluid force.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts, and further wherein.

DETAILED DESCRIPTION

Figure 1:
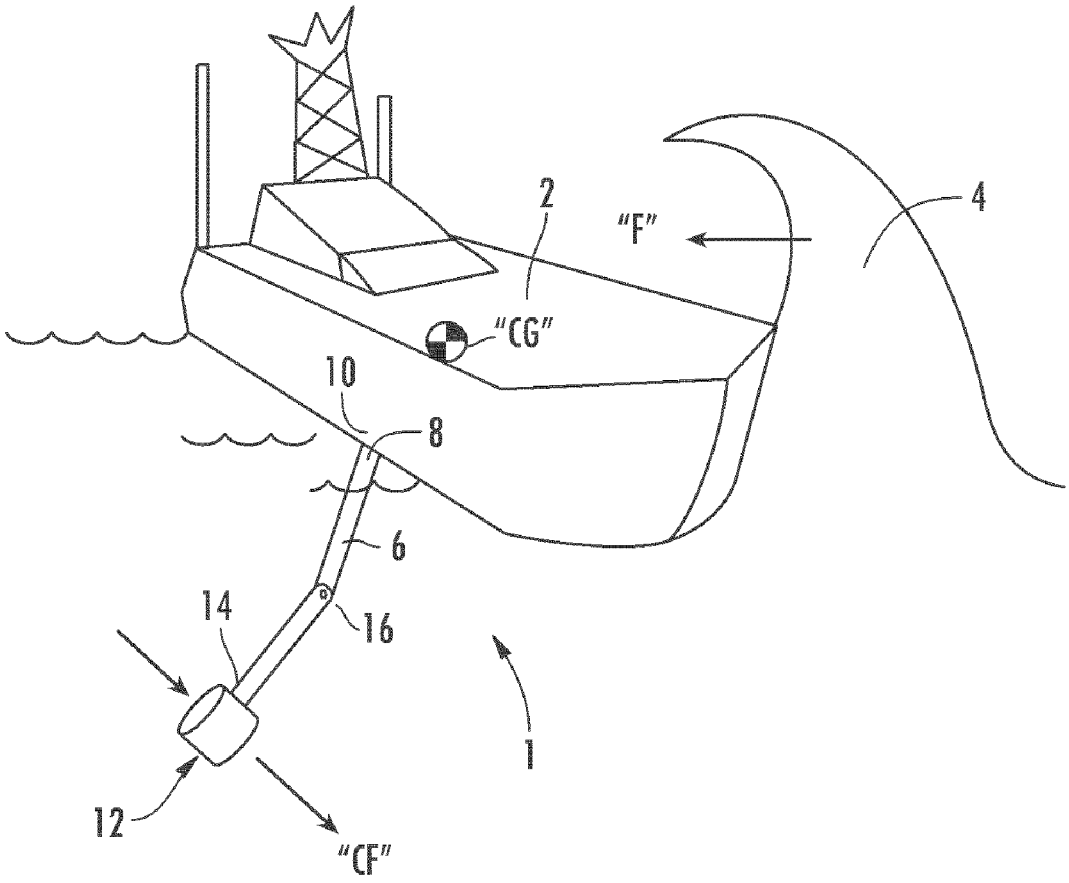
FIG. 1 is an isometric view of the disclosed system employed in an exemplary ship-board application.

In the accompanying drawings, like items are indicated by like reference numerals. This description of the preferred embodiments is intended to be read in connection with the accompanying drawings, which are to be considered part of the written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

The disclosed system may be referred to as having two portions: (1) a stability portion, and (2) a navigation portion. The stability portion includes a six (6) Degree of Freedom (DOF) manipulator to position and orient a thruster which supply a counteracting force to the water, sensors to measure the state of the ship and to measure the forces of impinging waves, and a computer (processor) to run software that measures the state of the ship, senses the waves and controls the manipulator and thruster. In addition to this list of hardware, low-level software may be required to interpret the output of each of the sensors, and to control the arm and thruster combination. The navigation portion includes an analytical system that selects an optimum ship's travel path based on visual and radar inputs of sea conditions, including the presence of waves.

Thus, the disclosed system utilizes dynamic stability techniques to keep the boat upright in high sea states. Referring to FIG. 1, a system 1 for stabilizing a ship 2 is illustrated. The ship 2, having a center of gravity "CG", is shown subjected to the force "F" of a wave 4 at sea. The system 1 comprises an elongated manipulator 6 having proximal end 8 affixed to the ship's structure 10, which can include the hull or keel. The system 1 may also comprise a thruster 12 positioned at a distal end 14 of the manipulator 6. The manipulator 6 may be adjustable to facilitate rapid positioning of the thruster 12 to provide a counterforce "CF" to counteract the force of the wave 4, thereby reducing the effect of the wave's force on the ship's stability. The manipulator 6 may have at least one adjustable joint 16, which can be a swivel joint, a pivot joint, or a combination of the two, to enable the manipulator to position the thruster 12 in a wide variety of desired positions during operation. In one embodiment, the manipulator 6 may have a plurality of joints to provide six DOF with respect to the ship 2.

Although a single manipulator 6 and thruster 12 are shown in FIG. 1, it will be appreciated that the system 1 may include multiple manipulators and thrusters positioned at various points on or along the ship, and that a single manipulator can also have multiple thrusters. In addition, although the system 1 will be described in relation to its application to a ship 2 at sea, it will be appreciated that the disclosed system is equally applicable to floating bodies of any kind, including oil and gas rigs, cruise liners, and the like, floating in any of variety of type bodies of water.

As noted, the manipulator 6 may be operable to position the thruster 12 at a desired position and orientation with respect to the vessel so that the thruster 12 can apply a counter-thrust to the water, which may include one or more waves. By positioning the thruster 12 to counteract the force of impinging waves, an active balance may be achieved to maintain the ship 2 substantially erect in rough seas. As will be described in greater detail later, the manipulator 6 may be automatically controlled in this effort by a control system (FIG. 3) that measures the force of a wave or waves on the hull of the ship 2, and automatically positions the thruster 12 to provide an appropriate counteractive force to the water.

Figure 2:
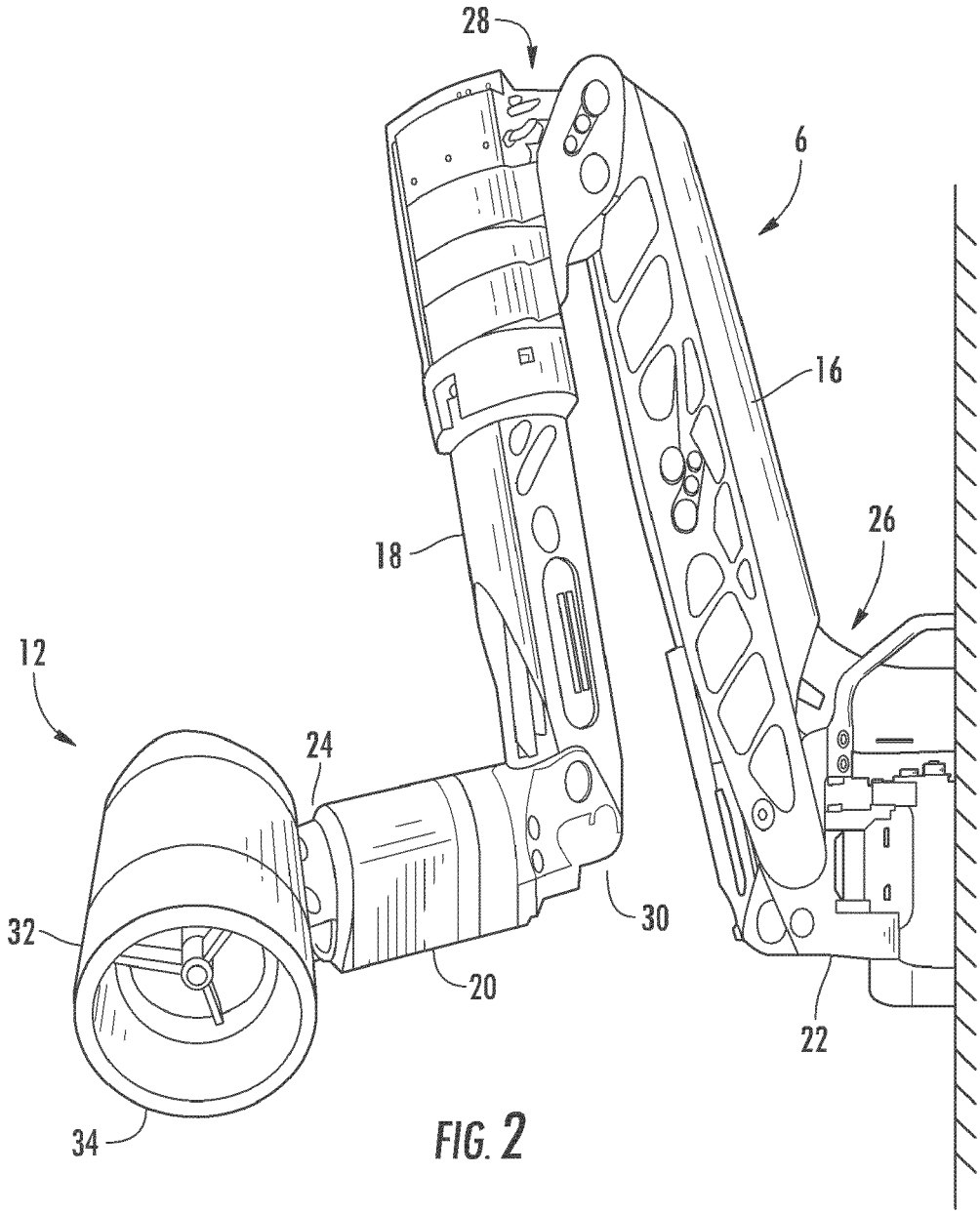
FIG. 2 is an isometric view of an exemplary manipulator and thruster for use as part of the disclosed system.

Referring now to FIG. 2, the manipulator 6 may be a controllable robot arm having one or more articulable segments. Examples of suitable commercial manipulators include those sold by Schilling Robotics LLC, 201 Cousteau Place, Davis, Calif. 95618-5412; Kraft Robotics, 11667 West 90th Street Overland Park, Kans. 66214, and Western Space & Marine, 53 Aero Camino, Santa Barbara, Calif. 93117-3103.

In the illustrated embodiment, the manipulator 6 has multiple independent arm segments 16, 18, 20 to provide a high degree of adjustability so that the thruster 12 can be rapidly positioned at any of a variety of desired positions with respect to the ship 2. The arm segments 16, 18, 20 may be sized, depending upon the individual application, to result in a desired overall length for the manipulator 6 that will provide an appropriate moment to enable force applied by the thruster to maintain the ship's stability. In addition, the physical strength characteristics of the manipulator 6 may be varied depending on the size of the ship being served and the nature of the seas in which the ship will operate.

As noted, the extended length of the manipulator 6 may be the maximum moment arm for the balancing moment. The virtual moment arm (i.e., the distance from the base 22 of the first segment 16 to the end 24 of the third segment 20) may be adjustable by a combination of bending (rotation of the joint) at what are referred to as the shoulder 26, elbow 28, and wrist 30 joints of the manipulator 6. Since these joints 26, 28, 30 are in the same plane, they can effectively extend and retract the manipulator 6.

Thruster 12 may, in its most basic form, comprise a motor driven propeller 32 in a duct 34. Examples of suitable commercial thrusters include those offered by TELL Technology Ltd, One Ropley Business Park, Ropley, Hampshire SO24 0BG, England; and Innerspace Corporation, 1138 East Edna Place, Covina, Calif. 91724. Like the manipulator 12, the size and power of the thruster 12 may be chosen depending on the size of the ship 2 being served, as well as the nature of the seas in which the ship will operate.

The thruster 12 may be connected to the manipulator 6 such that the thruster and manipulator are rigidly fixed together. Alternatively, the connection between the thruster and manipulator may be such that a degree of articulability is provided between the two so that the thruster can move (swivel, etc.) with respect to the manipulator.

Figure 3:
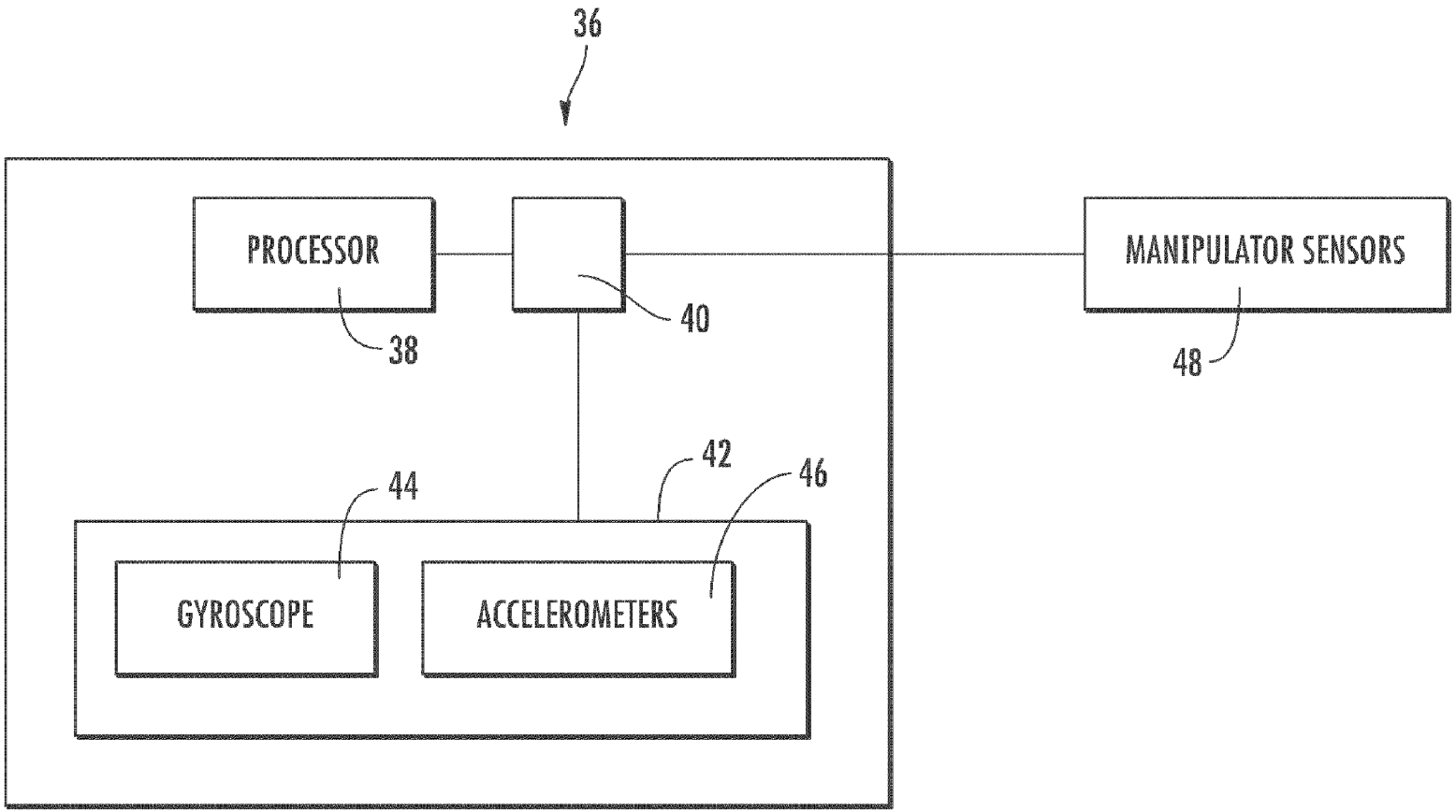
FIG. 3 is a schematic of an exemplary control system for use as part of the disclosed system.

Referring now to FIG. 3, the control system 36 may comprise a processor 38, electronics 40, and an integral sensor suite 42 including fiberoptic gyroscopes 44, accelerometers 46, and software running on the processor 38 for achieving dynamic stability in high sea states. Additional sensors 48 would be positioned on the manipulator 6 for facilitating control of the manipulator. Exemplary electronics 40 would include a position sensor 41 located at each arm joint 26, 28, 30, a force/torque sensor 43 located in the robot "wrist" joint 30, as well as appropriate input/output electronics, a processor, servo boards, and microprocessors to control each joint. The sensor suit 42 would be located at or near the center of gravity "CG" of the ship to measure the motion of the ship 2, including tilt, roll and yaw. If tilt cannot be derived from the sensors in the sensor suite 42, an additional tilt sensor could be used with a compass and the gyros and accelerometers as the suite. This combination of sensors can be combined into an Inertial Navigation Unit or Inertial Measurement Unit (IMU), and may also be coupled to a GPS receiver.

As previously noted, the disclosed system 1 uses the center of gravity "CG" and center of buoyancy of the ship 2, as well as a controlled thrust at the end of the manipulator 6, to optimally control the ship's state against impending waves. Center of gravity "CG" may be calculated during the design of the ship, or it may be determined through testing after the ship is built. Test methods may include suspending the ship 2 and finding its fulcrum based on moving and balancing the load until an equilibrium is reached. The center of buoyancy can be determined in a number of ways, including measurement with liquid level sensors, derivation from pressure sensors, using a gyroscope, using accelerometers, or it can be calculated from mass and shape parameters.

The act of balancing is a dynamic problem described by a set of linear differential equations. Stability is achieved by an optimal control system that tries to minimize all the different costs in the system, which is described by a quadratic function. This means that the settings of the processor 38 (see FIG. 3) governing the manipulator 6 and the thruster 12 are obtained by using a mathematical algorithm that minimizes the cost function with weighting factors.

Figure 4:
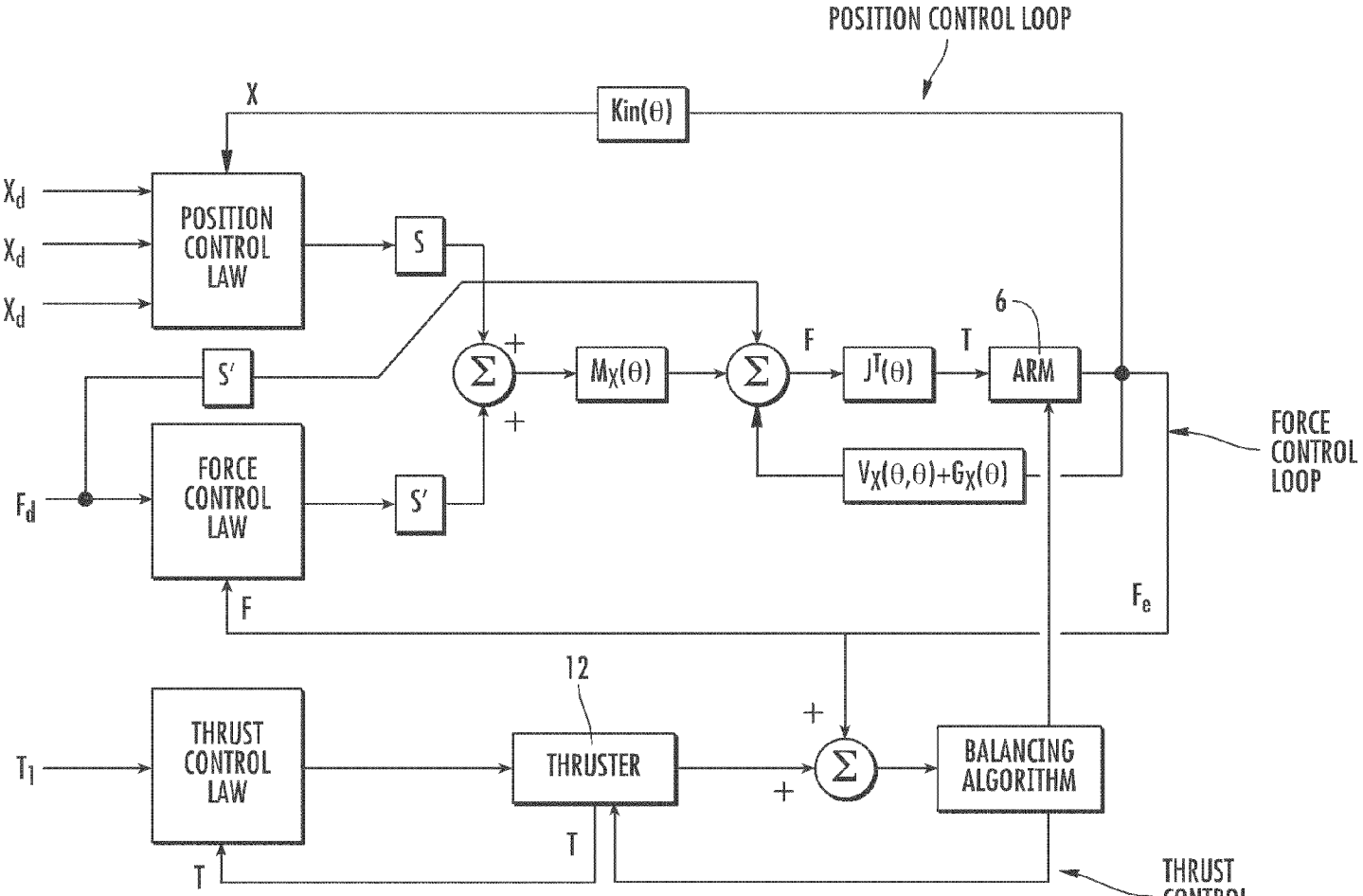
FIG. 4 is an exemplary quadratic regulator algorithm.

FIG. 4 illustrates an example of such an algorithm—termed a quadratic regulator algorithm—that may be employed for this purpose, in which $x_d$ represents the desired manipulator position; x represents the actual manipulator position; S represents an S matrix, which is a switch matrix that sets the mode for position control; S' represents an S' matrix, which is a switch matrix that sets the mode for force control; $J^T(\theta)$ represents a transpose Jacobian; F represents force at the manipulator 6; T represents thrust of the thruster 12; $V_x(\theta, \theta)$ represents the velocity term; $G_x(\theta)$ represents the gravity term; $Mx(\theta)$ represents the mass matrix or mass term; Kin $(\theta)$ represents kinematics; and $F_e$ represents force acting on the environment. The control system for the manipulator 6 is a hybrid design, combining position control, force control, and thrust control feedback loops. Each loop has its own sensor system and control law, with the control laws of the groups being added together before being sent to the manipulator control as a control signal. The "Position Control Law," the "Force Control Law," and the "Thrust Control Law" and the Balancing Algorithm are all well known in the art of robotic control systems (see, e.g., U.S. Pat. Nos. 5,414,799 to Seraji and 5,276,390 to Fisher et al., which are incorporated by reference herein).

Force and moment sensing $F_d$ at the wrist 30 of the manipulator 6 is provided using a robotic force/torque sensor. This force and moment information is input into the force control law. In parallel, the manipulator 6 is controlled using inputs of position, velocity, and acceleration measured at each of the individual rotational joints 26, 28, 30 of the manipulator 6. The individual control laws, the Inverse Kinematics of the manipulator, and its Jacobian function are used to position and orient the thruster 12. In addition, a controller (not shown) is provided to modulate the output of the thruster 12. The forces and moments of the waves are balanced with the counter forces produced by the thruster 12 and the counter torque produced by the force of the thruster 12 projected by the manipulator 6. The output is a dynamic system that keeps the ship upright when disturbed by waves crashing into the side of the vessel.

The "cost" (function) may be defined as a sum of the deviations of key measurements from their desired values. In effect, the algorithm determines those controller settings that minimize the undesired deviations, like deviations from undesired rolling that will tip the ship. A quadratic cost function is defined as the feedback control law that minimizes the value of the cost. Thus, the quadratic regulator algorithm optimizes the controller. This means that the controller synthesizes and then adjusts the weighting factors to get the controller more "in line" with the specified design goals of the system. Thus, the quadratic regulator algorithm is an automated way of finding an appropriate state-feedback controller that defines the relationship between its adjusted parameters and the resulting changes in the controller's behavior.

Figure 5:
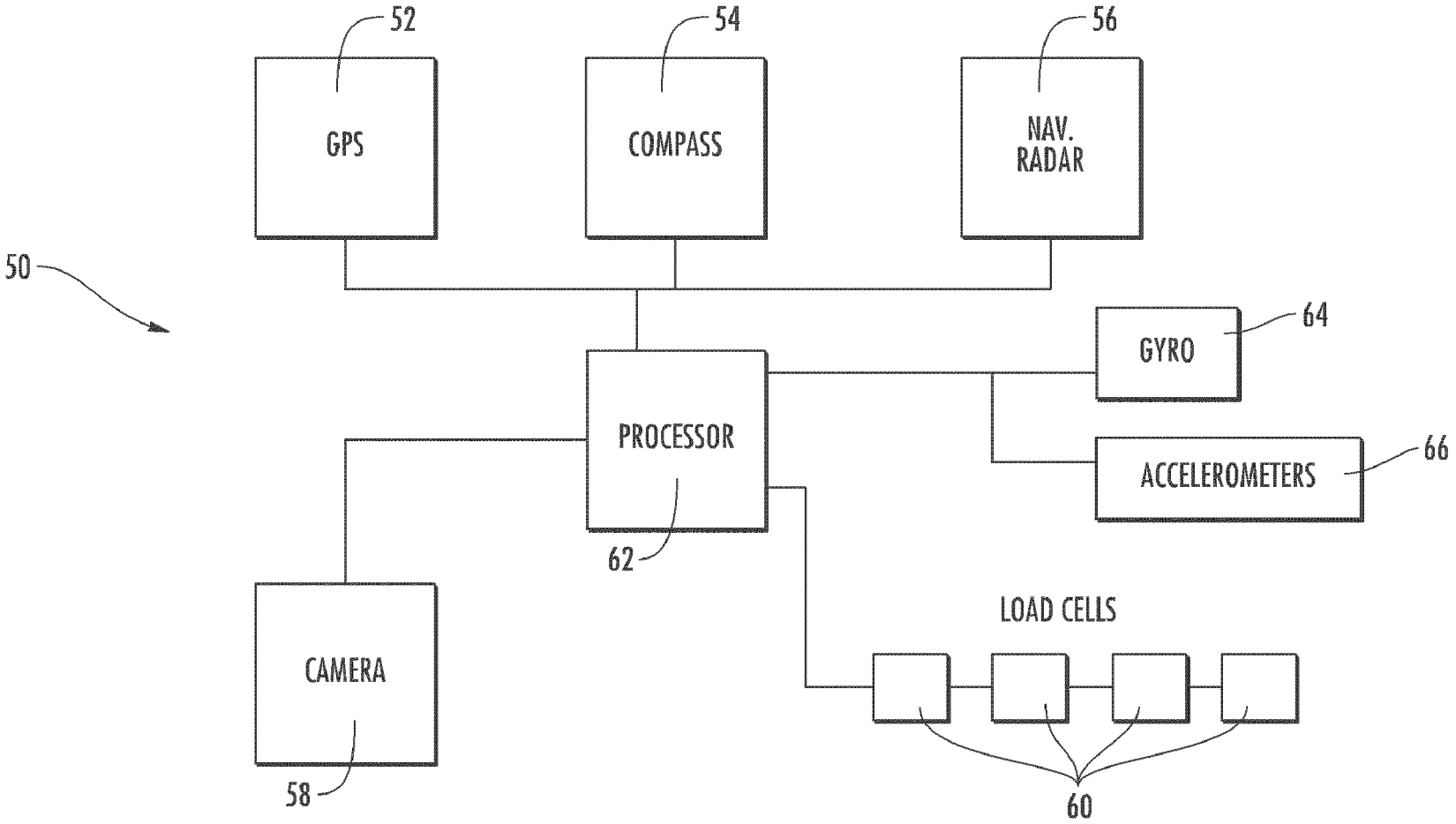
FIG. 5 is a schematic of an exemplary navigation system for use as part of the disclosed system.
Figure 6:
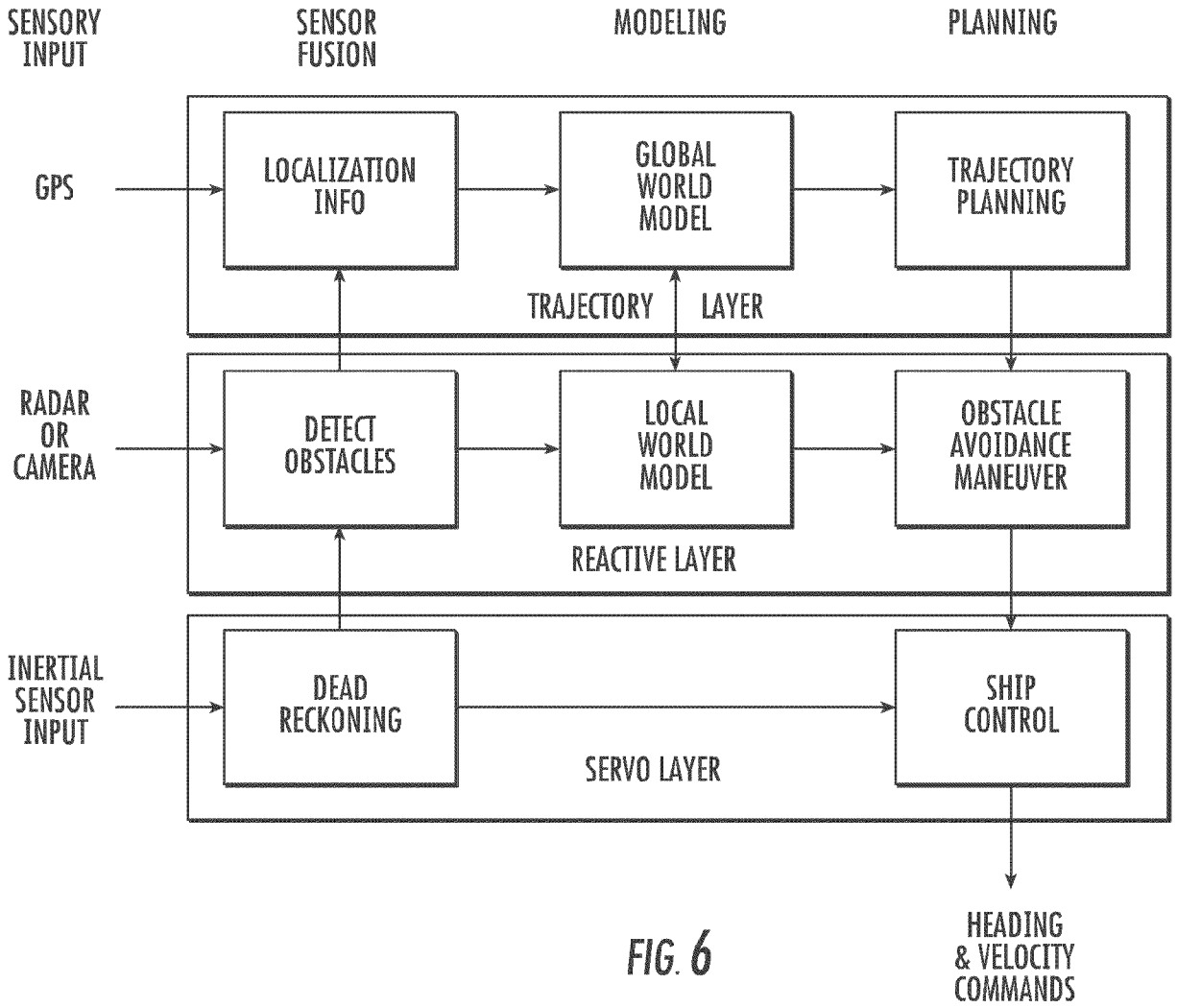
FIG. 6 is a flowchart describing an exemplary algorithm for fusing local terrain data.

Referring now to FIG. 5, a navigation system 50 may be provided to act as an auto pilot system for rough seafaring in sea conditions consisting of large waves, white caps, foam crests, and sea spray. The navigation system 50 may operate to select an optimum path through rough waters. The navigation system 50 may include GPS 52 (or a compass 54), and a navigation radar 56. These devices enable the sensing of the ship's position and can also be used to derive the ship's heading, or they can measure heading directly. These sensors may be supplemented with a camera 58 and load cells 60. Together with algorithms to fuse the local terrain data, a second processor 62 can be used to automatically steer the ship 2. An example of an appropriate algorithm is shown in FIG. 6.

The navigation system uses the general sense-plan-act algorithm. The architecture is hierarchical and layered with a servo layer (at the bottom), a reactive layer (in the middle), and a navigational or trajectory layer (at the top). The servo layer has the fastest update rate, followed by the middle layer which runs slightly slower, and the top layer which updates at the lowest update rate (allowing the planner to plan a trajectory). The servo layer uses inertial sensing data received from an Inertial Measuring Unit to dead reckon (based on heading and velocity) the ship.

The reactive layer is used to redirect the ship in the presence of potential obstacles, such as large waves. A radar or camera 58 is used to identify potential obstacles that pose a threat to the ship. An obstacle avoidance maneuver (such as using a potential field approach) is used to direct or steer the ship around the obstacles. This same radar or camera will also be used to build a 2.5D (two and a half dimensional) or 3D range map of the local area around the ship. Either type of map will work for obstacle maneuvering similar to what is currently used by unmanned ground vehicles. In one embodiment, the range and resolution of this map would have a look ahead range of approximately 50 meters with a resolution to resolve waves as small as a few meters tall.

The highest layer is the trajectory layer. This layer plans the trajectory or path of the ship in a world coordinate frame. GPS is used to determine the location of the ship (also known as the localization problem), especially if it is on or diverting off its planned trajectory. This information tells the ship if it is on the planned trajectory or not. When the ship gets off its path, it makes adjustments in order to return to its planned path. Commands from the trajectory layer are used to keep the ship on its path, and are passed down to the low level controller and simultaneously make adjustments for any reactive maneuvers. The GPS sensor can correct any drifting of the inertial sensing used in dead reckoning, and the map created by the radar or camera is correlated with a global map that is registered to global coordinates (sometimes referred to as sensor fusion). Maps modeled at the local level are reconciled and fused with maps on the larger scale (global) to gain a knowledge of the environment about the ship. Sensing from multiple sensors at varying resolution is passed to the planner, resulting with a set of servo commands that are ultimately used to steer the ship.

The stabilization system (i.e., the processor 38, manipulator 6, and thruster 12) and the navigation system 50 are separate, however, the navigation system can re-direct the ship, thus steering the ship into calmer water. Similarly, by understanding the real-time forces on the ship, this information can be used to fine tune the navigation system (e.g., speed, heading and bearing). Thus, the stabilization system and the navigation system are complementary.

For navigation, a "two and a half dimensional" map is used. A two and a half dimensional map is simply a two-dimensional map which incorporates information regarding gravity. Gravity represents a vertical characteristic applied to each point in the planar two-dimensional map. To measure the direction of gravity, one or more gyroscopes 64 may be mounted as close to the center of gravity "CG" of the ship as practical. Accelerometers 66 may also be located close to the gyroscopes. Any physical offsets can be accounted for in the kinematics, which is typically represented by a six by six matrix. As the gyroscopes 64 drift with time, the accelerometers 66 will be used to re-calibrate the gyroscopes to their null position. Gyroscopes may drift for a variety of reasons (e.g., as a result of high frequency noise). To re-calibrate the gyroscopes 64, the accelerometers 66 may indicate an amount of drift, and when a predetermined limit is exceeded the gyroscope may be commanded to re-zero their readings.

A three dimensional map could also be desirable, and depending on the resolution, this may be a topographical type of map or an occupancy grid. The GPS 52, navigation radar 56 and second processor 62 may be used separately, or together with the control system 36 to result in an integrated overall system.

The stability of a ship 2 in high sea states is fundamentally equivalent to solving the inverted pendulum problem. To measure its direction of motion, Global Positioning System (GPS) data can be used to calculate vessel heading (i.e., direction). Due to the nature of waves and sets of waves in a storm, however, steering does not adhere to the traditional ground-robot path planning problem, but to a local behavioral approach to navigation. The ground robot path planning problem is to take a mobile robot from a starting point to a goal point. There are multiple planning techniques such as occupancy grids, Voronoi diagrams, exact cell-decomposition approach, potential fields, etc. to plan an optimal path. The same techniques can be used to plan the motion of a ship, taking waves as obstacles and marking them as negative consequences to be avoided. Thus, the smoothest or safest path becomes the goal of the planning algorithm, which is described in more detail later in relation to FIG. 8.

The system 1 must sense and enable the ship to traverse simultaneously in order to negotiate the waves, eliminating planning which can be time consuming. The navigation problem uses reactive control theory to chart its way through a patch of rough seas. Reactive control refers to the capability of a system to react quickly to state changes. Reactive controllers have very tight code loops that make fast but simple decisions. This type of controller is well suited to dynamic worlds where behaviors such as obstacle avoidance are implemented. Exemplary publications that describe reactive control theory include "Vehicles: Experiments in Synthetic Psychology," by Valentino Braitenberg, MIT Press, 1986, ISBN 0-262-52112-1; "A Simple Reactive Architecture for Robust Robots", by Rajiv Desai and David Miller, Proc. of the IEEE International Conference on Robotics & Automation (ICRA), Nice, France, May 1992; "Introduction to AI Robotics," by Robin Murphy, MIT Press, 2000, ISBN 0-262-13383-0; "Behavior-Based Robotics," by Ronald Arkin, MIT Press, 1998, ISBN 0-262-01165-4; "A Robust Layered Control System for a Mobile Robot", by R. A. Brooks, IEEE Journal of Robotics and Automation, Vol. 2, No. 1, March 1986, pp. 14-23; "Intelligence Without Reason", by R. A. Brooks, Proceedings of 12th Int. Joint Conf. on Artificial Intelligence, Sydney, Australia, August 1991, pp. 569-595; the entirety of which are incorporated by reference herein.

Figure 7:
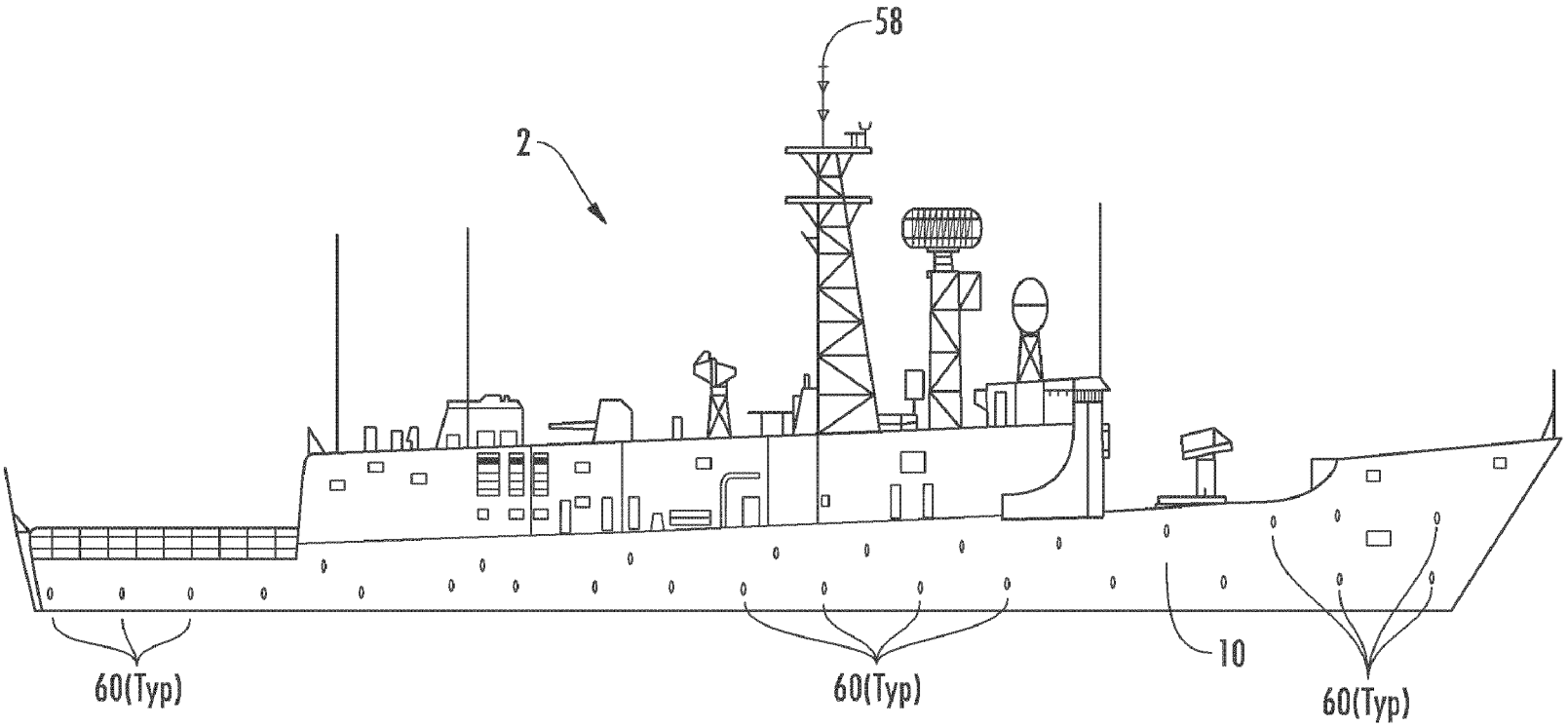
FIG. 7 is a side view of an exemplary distribution of sensors on a ship incorporating the system of FIG. 1.

During navigation, the load cells 60 may be used to "feel" the waves, and the radar 56 along with the panoramic camera 58 will be used to "see" and pick an appropriate course (analogous to a probability predictor). Referring to FIG. 7, the load cells 60 may be equally spaced on the hull 10 of the ship 2. As will be appreciated, the more locations measured on a grid pattern, the better the results. The load cells 60 may be distributed horizontally and vertically. It is contemplated that at least six load cells should be provided on each side of the ship, with one or two at the fore and aft ends of the ship. Greater numbers of load cells are preferred, since an increase in the number of sensory inputs will equate to a higher fidelity model.

The panoramic camera(s) 58 may be placed at or near the highest point on the ship, (e.g., at the top of the ships mast or similar location). The camera(s) 58 may be pointed out and downward to obtain a desired view of impending water and waves. For a fuller view of the ship's local surroundings, the camera(s) may be positioned with a pan/tilt device (commonly referred to as a gimbal). The camera(s) may be connected to the onboard computer, which is the brains and coordinates the navigation of the ship, as well as computing the stability control. This is analogous to an automobile with traction control.

Surface water is the most difficult environment for a mobile robot to negotiate. A ground environment is cluttered with many potential obstacles, but the surface water environment is difficult because of its color and non-descript characteristics, i.e., most water looks alike through a camera. A Gaussian or a Sobel operator may be used (for edge detection) to build a rough order model of the waves in the immediate area around the ship to react to. The model of the waves will be developed with cameras and processed using computer vision algorithms. A common computer vision algorithm is a Sobel operator (named for its inventor), while other techniques utilize a Gaussian approach which is based on probability distributions. The way these algorithms work is that to find discontinuities in the scene which equate to a mathematical derivative function. For example, these techniques find edges in a 2-dimensional image. These edges form boundaries on a surface, which in the subject case is a wave. This edge can be separated from the sky above and other features such as flat water. Having a shape or object defined, the height and width of a wave can be calculated from this information. This technique is dynamic since waves are always forming, growing, combining, or diminishing all the time. A series of waves is often distinguished as a set. In the robotic world, waves would be defined as moving obstacles. When negotiating an obstacle, the ship has a choice of going around the obstacle, maybe stopping or slowing down until the obstacle no longer is an obstacle, or passing through the obstacle.

Figure 8:
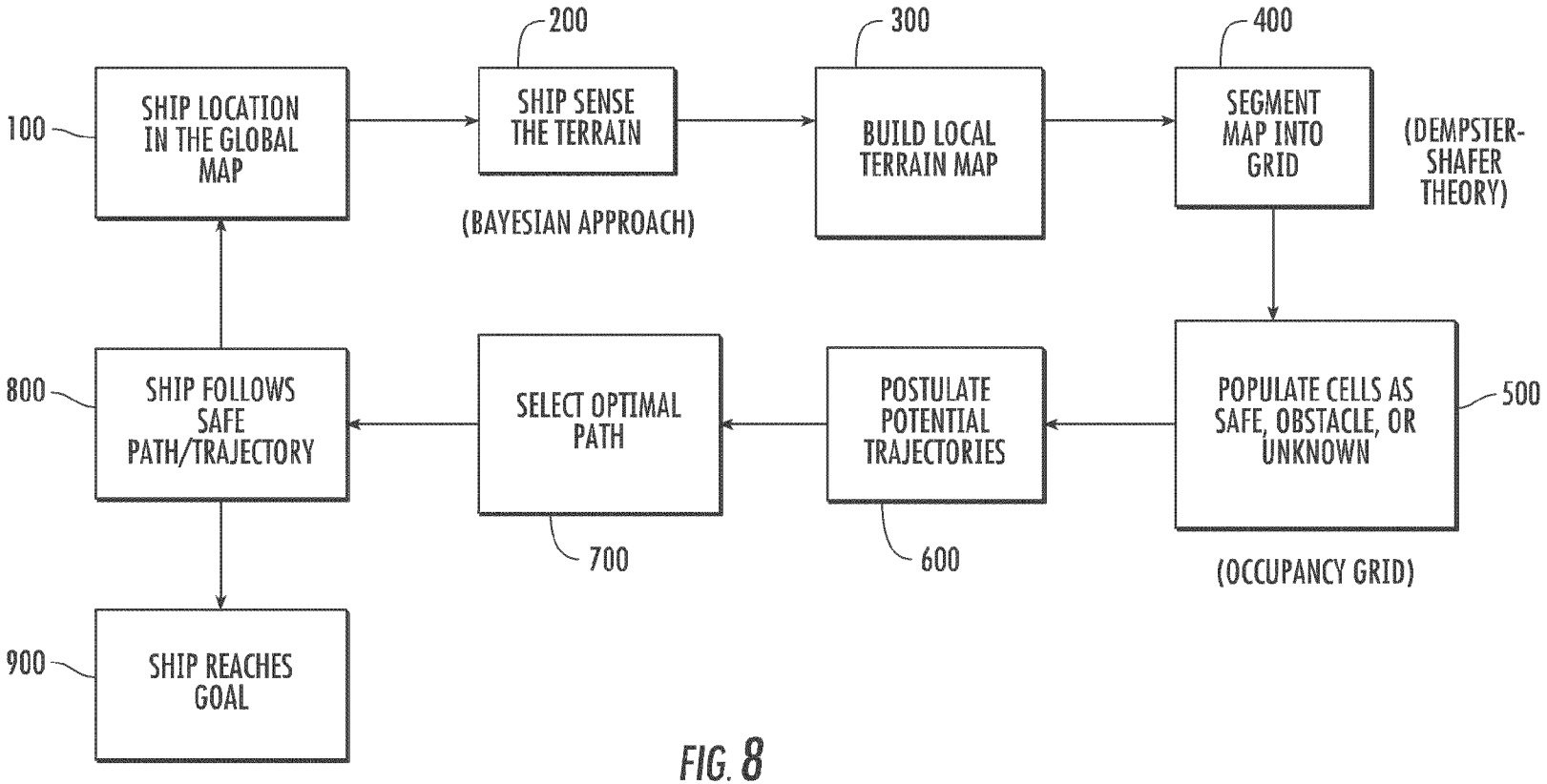
FIG. 8 is a flow chart describing a process used as part of the disclosed system.

FIG. 8 is a flow chart describing the ship navigation process using the panoramic camera 58. At step 100, the ship 2 (i.e., its sensors and/or crew) may have some general knowledge on where it is and where it has to go (i.e., some goal location). This is typically determined with GPS 52. At step 200, the panoramic camera(s) 58 may sense the local terrain around the ship using a Bayesian approach (based on probabilities). At step 300, the software may build a local terrain map which can be the 2½-D map as previously described. At step 400, using an occupancy grid, the map is then divided into cells that are specified by the largest obstacle to be avoided. The cell could be sized to be about the equivalent size of a small boat, (e.g. an 11-meter (m) long rigid hull inflatable boat (RHIB) would be detected by a 10 m×10 m grid size.) At step 500, each cell in the grid may be classified and color coded as safe, occupied, or unknown using the Dempster-Shafer Theory. At step 600, multiple splines are then calculated as potential paths for the ship to take. The path planning algorithm selects the appropriate trajectory at step 700 and at step 800 the ship is navigated to follow the selected path. This process is repeated over and over until the ship reaches its intended goal at step 900, such as a calm region or a distance away from the rough seas.

This navigation approach incorporates an aspect of hierarchy (similar to Three-T architecture) since there is a heading and destination for the mission. Autonomous navigation is based on different types of architectures: 1) hierarchical (very deterministic and used a lot in a military structure), 2) behaviorist or reactive (insects use these primitive behaviors to forage for food or to explore), or 3) a hybrid of both. Three-T stands for three-tiers and is a hybrid architecture. The result is an architecture that can plan as well as react to situations, similar to the way the human body works.

Although the invention has been described in terms of exemplary embodiments, it is not limited thereto. The features of the system and method have been disclosed, and further variations will be apparent to persons skilled in the art. All such variations are considered to be within the scope of the appended claims. Reference should be made to the appended claims, rather than the foregoing specification, as indicating the true scope of the disclosed method. The appended claims should be construed broadly, to include such other variants and embodiments of the invention which may be made by those skilled in the art without departing from the scope and range of equivalents of the invention.

The methods described herein may be automated by, for example, tangibly embodying a program of instructions upon a computer readable storage media capable of being read by machine capable of executing the instructions. A general purpose computer is one example of such a machine. A non-limiting exemplary list of appropriate storage media well known in the art would include such devices as a readable or writeable CD, flash memory chips (e.g., thumb drives), various magnetic storage media, and the like.

The functions and process steps herein may be performed automatically or wholly or partially in response to user command. An activity (including a step) performed automatically is performed in response to executable instruction or device operation without user direct initiation of the activity.

The invention claimed is:

1. A system for stabilizing a floating body, comprising:

a manipulator connected to the floating body, the manipulator comprising an articulatable arm having a first end and a second end;

a thruster positioned on the manipulator, at least a portion of the thruster rotatable about an axis for generating thrust;

a first plurality of sensors for measuring at least a first characteristic of the floating body;

a second plurality of sensors for measuring a fluid force adjacent to the floating body; and a controller in communication with the first and second plurality of sensors, the manipulator and the thruster;

wherein the second end of the articulatable arm is selectively rotatable with respect to the first end about at least three axes independent of the axis of rotation of the thruster;

wherein the controller is configured to adjust a position of the manipulator and the thruster based on information received from the first and second plurality of sensors; and wherein the thrust generated by the thruster counteracts at least a portion of the measured fluid force.

2. The system of claim 1, wherein the articulatable arm comprises a plurality of rotatable joints, wherein the plurality of rotatable joints provide the second end of the manipulator with six independent degrees of freedom with respect to the first end.

3. The system of claim 2, wherein the first end of the manipulator is connected to the floating body and the thruster is connected to the second end of the manipulator.

4. The system of claim 1, wherein the thruster comprises a propeller.

5. The system of claim 1, wherein the first characteristic comprises at least one of the center of gravity and the center of buoyancy of the floating body.

6. The system of claim 1, wherein the first plurality of sensors are selected from the list consisting of gyroscopes and accelerometers.

7. The system of claim 1, wherein the second plurality of sensors comprise load cells for measuring a fluid force.

8. The system of claim 1, further comprising a plurality of manipulator sensors disposed on the manipulator, wherein the manipulator sensors provide information to the controller to facilitate positioning of the manipulator.

9. The system of claim 8, wherein the articulatable arm further comprises three joints for rotating the second end about the three axes, and at least a portion of the plurality of manipulator sensors are positioned at the three rotatable joints.

10. The system of claim 1, further comprising a navigation system and a camera for sensing visual information regarding a sea state surrounding said floating body, wherein the controller is configured to receive information from said camera and to provide navigation information to the navigation system.

11. The system of claim 10, wherein the navigation system further comprises a global positioning system (GPS) and a navigation radar.

12. A system for stabilizing a floating body, comprising:

a manipulator connected to the floating body, the manipulator comprising an arm having a first end and a second end, the second end rotatable with respect to the first end about at least three orthogonal axes;

a thruster positioned on the manipulator arm;

a first plurality of sensors for measuring at least a first characteristic of the floating body;

a second plurality of sensors for measuring a fluid force adjacent to the floating body; and a controller configured to adjust a position of the manipulator arm and the thruster based on information received from the first and second plurality of sensors;

wherein a thrust generated by the thruster counteracts at least a portion of the measured fluid force; and wherein the manipulator arm comprises a plurality of joints for providing the second end of the manipulator arm with six independent degrees of freedom with respect to the first end.

13. The system of claim 12, wherein the manipulator arm comprises three rotatable joints, each of the joints defining one of the three axes of rotation.

14. The system of claim 12, wherein the first end of the manipulator is connected to the floating body and the thruster is connected to the second end of the manipulator arm.

15. The system of claim 12, wherein the thruster comprises a propeller disposed in a flow duct.

16. The system of claim 12, wherein the first characteristic comprises at least one of the center of gravity and the center of buoyancy of the floating body.

17. The system of claim 12, wherein the first plurality of sensors are selected from the list consisting of gyroscopes and accelerometers.

18. The system of claim 12, wherein the second plurality of sensors comprise load cells for measuring a fluid force.

19. The system of claim 12, further comprising a plurality of manipulator sensors disposed on the manipulator, wherein the manipulator sensors provide information to the controller to facilitate positioning of the manipulator.

20. The system of claim 19, wherein the manipulator arm further comprises three rotatable joints, and at least a portion of the plurality of manipulator sensors are positioned at the three rotatable joints of the manipulator arm.

21. The system of claim 12, further comprising a navigation system and a camera for sensing visual information regarding a sea state surrounding said floating body, wherein the controller is configured to receive information from said camera and to provide navigation information to the navigation system.

22. The system of claim 21, wherein the navigation system further comprises a global positioning system (GPS) and a navigation radar.

23. The system of claim 1, wherein the articulatable arm comprises three rotatable joints, each of the joints defining one of the three axes of rotation.

24. The system of claim 1, wherein the three axes of rotation comprise three mutually orthogonal axes of rotation.

25. A system for stabilizing a floating body, comprising:

a manipulator connected to the floating body, the manipulator comprising an articulatable arm having a first end and a second end, the second end being selectively rotatable with respect to the first end about at least three axes;

a thruster positioned on the manipulator:

a first plurality of sensors for measuring at least a first characteristic of the floating body;

a second plurality of sensors for measuring a fluid force adjacent to the floating body; and a controller in communication with the first and second plurality of sensors, the manipulator and the thruster;

wherein the articulatable arm comprises six rotatable joints for providing the second end of the manipulator with six degrees of freedom with respect to the first end;

wherein the controller is configured to adjust a position of the manipulator and the thruster based on information received from the first and second plurality of sensors; and wherein a thrust generated by the thruster counteracts at least a portion of the measured fluid force.

26. The system of claim 12, wherein the plurality of joints comprises at least six rotatable joints.

27. The system of claim 1, wherein the distance between the first end and the second end of the articulatable arm may be altered by rotating the second end of the manipulator arm about at least one of the three axes.

28. The system of claim 12, wherein the distance between the first end and the second end of the manipulator arm may be altered by rotating the second end of the manipulator arm about at least one of the three axes.

* * * * *